US011280586B2

(12) United States Patent
Olsson et al.

(10) Patent No.: US 11,280,586 B2
(45) Date of Patent: Mar. 22, 2022

(54) ARRANGEMENT FOR REDUCING RECOILING FORCES ON A SIGHT OR OTHER COMPONENT MOUNTED ON A BARREL OF A WEAPON

(71) Applicant: SAAB AB, Linköping (SE)

(72) Inventors: Christian Olsson, Hammarö (SE); Sven Lindh, Karlstad (SE); Peter Karlsson, Sköllersta (SE)

(73) Assignee: SAAB AB, Linköping (SE)

( * ) Notice: Subject to any disclaimer, the term of this patent is extended or adjusted under 35 U.S.C. 154(b) by 1 day.

(21) Appl. No.: 16/494,029

(22) PCT Filed: Mar. 15, 2017

(86) PCT No.: PCT/SE2017/050251
§ 371 (c)(1),
(2) Date: Sep. 13, 2019

(87) PCT Pub. No.: WO2018/169460
PCT Pub. Date: Sep. 20, 2018

(65) Prior Publication Data
US 2021/0116217 A1 Apr. 22, 2021

(51) Int. Cl.
*F41G 11/00* (2006.01)

(52) U.S. Cl.
CPC ..... *F41G 11/002* (2013.01); *F41G 11/003* (2013.01)

(58) Field of Classification Search
CPC ..... F41G 11/002
USPC ..... 42/1.06
See application file for complete search history.

(56) References Cited

U.S. PATENT DOCUMENTS

| | | | | |
|---|---|---|---|---|
| 1,452,651 | A * | 4/1923 | Norrlin | F41G 11/002 362/110 |
| 4,027,414 | A | 6/1977 | Felix | |
| 9,354,022 | B2 * | 5/2016 | Eriksson | F41G 1/387 |
| 2006/0144216 | A1 | 7/2006 | Shipman et al. | |
| 2010/0269681 | A1 | 10/2010 | Shipman et al. | |
| 2015/0276351 | A1 | 10/2015 | Pekarek et al. | |

FOREIGN PATENT DOCUMENTS

| | | | |
|---|---|---|---|
| DE | 2703990 | A1 | 8/1978 |
| FR | 3016959 | A1 | 7/2015 |
| WO | 2011075026 | A1 | 6/2011 |
| WO | 2011075026 | A9 | 6/2011 |

OTHER PUBLICATIONS

International Search Report and Written Opinion in corresponding International Application No. PCT/SE2017/050251 dated Jun. 2, 2017 (10 pages).
Extended European Search Report in correponding European Application No. 17900510.3 dated Oct. 27, 2020 (7 pages).

* cited by examiner

*Primary Examiner* — Reginald S Tillman, Jr.
(74) *Attorney, Agent, or Firm* — Jeffri A. Kaminski; Venable LLP

(57) ABSTRACT

The present invention relates to an arrangement for improving shooting accuracy of a weapon comprising i) a barrel 13, ii) at least one component iii) a holding device mounted on said barrel 13, said holding device comprising means for holding 1*a* said at least one component allowing said at least one component to be displaced relative to and in parallel with the barrel and the means for holding from 1 mm to 200 mm during which displacement said at least one component does not absorb any substantial recoiling forces.

8 Claims, 2 Drawing Sheets

Figure 1:
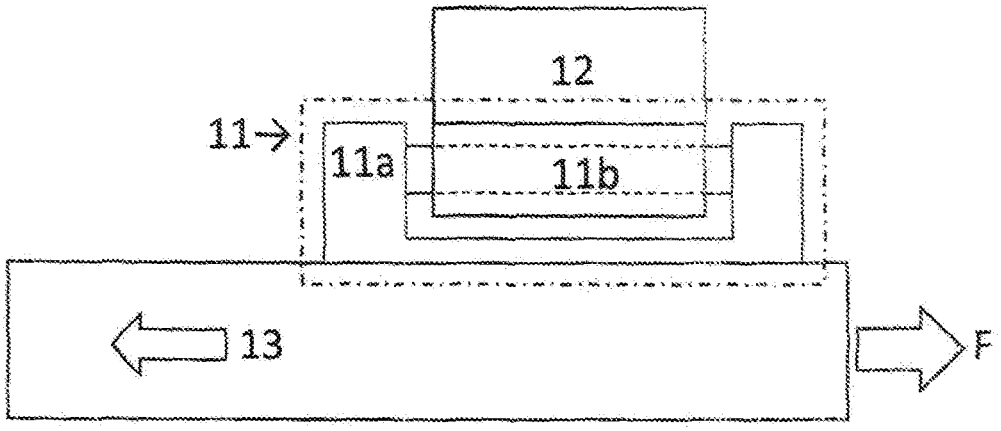

ARRANGEMENT FOR REDUCING RECOILING FORCES ON A SIGHT OR OTHER COMPONENT MOUNTED ON A BARREL OF A WEAPON

CROSS-REFERENCE TO RELATED APPLICATIONS

This application is a U.S. National Stage application of PCT/SE2017/050251, filed Mar. 15, 2017 and published on Sep. 20, 2018 as WO/2018/169460, all of which is hereby incorporated by reference in its entirety.

Dampening devices, muzzle brakes and other devices are known in the art to reduce recoiling forces arising in weapons subsequent to firing.

However, sights, range finders and other components commonly arranged on weapon parts are still exposed to considerable recoiling forces resulting in detrimental effects.

Components have conventionally been fixedly arranged to barrels whereby the components have immediately absorbed recoiling forces. The heavier the component, the heavier the recoiling force exerted on it. For example components such as sights have conventionally been fixed by glueing resulting in uncontrolled detrimental absorption of heavy loads subsequent to firing. Several drawbacks have been identified with such types of arrangement:

i) the barrel has become angled resulting in a modified trajectory for the projectile still present in the barrel when loads are transferred to a component such as a sight.

ii) fixedly arranged components such as sights may result in weak barrels turning oval.

iii) transferred loads may have a considerable impact on the strength of various parts of the weapon, e.g. glue lines fixing a sight.

iv) high degree of acceleration of electronics and other sensitive components may cause further damage over time.

Alternative solutions involving dampening recoiling forces on sights and other components mounted on the barrel by means of various resilient means are also known in the art. However, such immediate uptake of recoiling forces by a sight will influence shooting accuracy since the barrel will be influenced by immediate absorption of such recoiling force when the projectile fired still is present in the barrel which in turn will influence the trajectory of the projectile. The above problems are in particular associated with weapons such as ordnance or heavy arms equipped with heavy components. However, problems as discussed above may also arise for lighter components arranged in small firearms. The present invention intends to solve at least one of the above-stated drawbacks. In particular, the invention intends to improve shooting accuracy by eliminating or at least reducing the impact of absorption of recoiling forces by components such as sights while a projectile still has not left the barrel. The arrangement of the invention also minimizes recoiling forces in non-axial directions.

THE INVENTION

The invention relates to an arrangement for improving shooting accuracy of a weapon comprising i) a barrel, ii) at least one component iii) a holding device mounted on said barrel, said holding device comprising means for holding said at least one component allowing said at least one component to be displaced relative to and in parallel with the barrel and the means for holding from 1 mm to 200 mm during which displacement said at least one component does not absorb any substantial recoiling forces.

Preferably, following firing, the barrel and the holding device are immediately exposed to recoiling forces. The component, e.g. a sight, mounted on the means for holding is not immediately exposed to recoiling forces following firing since it is displaced in relation to the barrel and the holding device, for example by sliding on said means for holding on which it is mounted. Preferably, said means for holding comprises at least one shaft and/or at least one rail on which said at least one component is mounted and along which said at least one component is displaced following firing. Preferably, said at least one component comprises a sight, braking unit, range finder or a combination thereof. According to one embodiment, the sight is mounted on the means for holding, either directly or via other means such as a braking unit on which the sight is mounted. Preferably, said at least one component is positioned prior to firing on said means for holding allowing displacement, preferably slidable displacement, of said at least one component from 1 mm to 200 mm towards an end point of said means for holding where said at least one component will start to absorb recoiling forces. Preferably, said at least one component is displaceable 1 to 200 mm, more preferably 1 to 20 mm, or most preferably 5 to 15 mm, relative to the barrel and the means for holding without absorbing any substantial recoiling forces, i.e. without absorbing more than 5%, preferably without absorbing more than 1%, and most preferably without absorbing more than 0.1% of the total recoiling forces arising subsequent to firing but before the projectile has left the barrel. Preferably, said means for holding has a length of 1 to 400, for example 1 to 40 mm, or 5 to 30 mm, or for example 5 to 20 mm to allow for such displacement of said at least one component, for example if said at least said component initially before firing is positioned at the midpoint of said means for holding, e.g. a shaft. For example, if the length of the shaft is 20 mm and the component is placed on the midpoint of the shaft, it may be displaced 10 mm in both directions before colliding with an end point of said means for holding. According to one embodiment, said at least one component is positioned at a distance from 2 to 20 mm, preferably from 5 mm to 20 mm, for example from 5 to 15 mm from an end point of said means for holding, at which point said component will start to absorb recoiling forces. According to one embodiment, a braking unit, preferably provided with a sight mounted on it, is mounted on said means for holding allowing the braking unit to slide along said means for holding 2 to 20 mm, preferably from 5 mm to 20 mm, for example 5 to 15 mm without absorbing any substantial recoiling forces. The skilled person knows which length a means for holding suitably has to safeguard a certain displacement of the component is sufficient for it to be displaced without absorbing substantial recoiling forces during the period from firing until a projectile leaves the barrel. The skilled person can thus design appropriate length of a means for holding for different weapons according to specific needs for said weapons. Preferably, the means for holding said at least one component is at least one shaft or at least one rail or other means on which said at least one component can be linearly displaced a limited distance as defined herein without contacting an end point which causes said at least one component to start absorbing recoiling forces. As an example, following firing of a projectile, the barrel may start to move backwards in the firing direction. As a consequence, the holding device comprising the means for holding will then move in the same direction, i.e. backwards. Said at least one component will thus be displaced relative to the barrel and the means for holding since it is displaceable, for example by sliding, along said means for holding, without absorbing any recoiling forces or substantial recoiling forces. Said at least one component will not move itself but will describe a displacement relative to the means for holding since the distance from an end point of the means for holding will change as the means for holding moves following firing. A displacement thus occurs of said at least one component relative to the means for holding. During the time said at least one component has been displaced relative to the means for holding without absorbing substantial recoiling forces, said projectile has had time to leave the barrel during which displacement time said at least one component has not substantially absorbed any recoiling forces and thereby influenced the trajectory of a fired projectile. Thus, the trajectory of the projectile is not influenced by any substantial absorption of recoiling forces by said at least one component.

Preferably, securing means such as conventional securing means connect said holding device to a barrel.

According to one embodiment, said at least one component subsequent to its displacement is returned to its original position on the means for holding by means of resilient means such as a retraction spring, e.g. a pressure spring or coil spring having been lightly compressed (and absorbing unsubstantial recoiling forces) during the displacement of said at least one component.

Preferably, no or substantially no recoiling forces, most preferably no recoiling forces are absorbed by said at least one component prior to a fired projectile has left the barrel. Preferably, by the term substantially no recoiling forces is meant less than 5%, more preferably less than 1%, and most preferably less than 0.5% of the total recoiling forces exerted on the barrel subsequent to firing of a projectile are absorbed by said at least one component before the projectile has left the barrel.

By the term "projectile" is meant to include any bodies or munitions such as a bullet, shell, missile, warhead that can be shot from a weapon.

According to one embodiment, a braking unit absorbs recoiling forces after a projectile has left the barrel.

According to one embodiment, a braking unit is mounted on said means for holding to absorb recoiling forces so as to reduce peak acceleration of at least one component after the projectile has left the barrel.

According to one embodiment, said at least one component is a braking unit and a sight mounted on the braking unit. According to one embodiment, a braking unit and a sight are mounted on the same shaft in any order. For example, the braking unit can be positioned in front of said at least one component in the direction of the fired projectile. According to one embodiment, the order of positioning the braking unit and the sight may also be the opposite, i.e. the sight is positioned in front of the braking unit in the direction of the fired projectile, for example depending on the direction of recoiling forces arising following firing. According to one embodiment, the braking unit and the sight are not arranged on the same means for holding but on separate means for holding, e.g. separate shafts. According to one embodiment, a braking unit is arranged on both sides of the sight on the same shaft to provide for absorption of recoiling forces in two directions subsequent to firing of a projectile.

According to one embodiment, several holding devices may be arranged on the barrel, e.g. if the components cannot be conveniently arranged at one and the same holding device.

According to one embodiment, the securing means comprises means securing the holding device, which may be fixedly secured, to the barrel, e.g. glued thereto.

According to one embodiment, the holding device and the barrel may be displaced in either direction depending on the direction of the recoiling force.

According to one embodiment, said at least one component absorbs no or substantially no recoiling forces at any time. This can be accomplished by dimensioning the arrangement so as to allow axial displacement parallel to the barrel to such extent said at least one component never starts to absorb recoiling forces, not even after a projectile has left the barrel. According to one embodiment, at least two or three components are mounted on the means for holding.

The term "component" which sometimes is called "outer component" includes any component such as a sight, range finder, night vision device, ballistic calculator, braking unit etc. Preferably, said at least one component is a sight and/or a range finder. The term "at least one component" comprises in addition to e.g. a sight also e.g. a sight mounted on a braking unit which in turn is mounted on said means for holding.

The length of the means for holding, along which said at least one component is displaced, e.g. by sliding, must be dimensioned in relation to the recoiling energy absorbed subsequent to firing such that said component does not absorb recoiling forces before the projectile has left the barrel. Such recoiling energy varies depending on several parameters including the type of projectile used, type of weapon etc. A skilled person is capable of dimensioning a suitable length of a shaft or other means on which said at least one component arranged to allow forward and backward movements thereof. The range for displacement defined herein has been found to safeguard said at least one component does not collide or start absorption of recoiling forces for any conceivable weapon. Thus, the means for holding on which said at least one component is arranged, has such dimensions allowing said relative displacement from said at least one component's original position on the means for holding.

According to one embodiment, said at least one component is displaced in the same direction as the fired projectile. According to one embodiment, said at least one component is displaced in the opposite direction of a fired projectile. According to one embodiment, said at least one component is displaced first in one direction and subsequently in the opposite direction depending on the recoiling forces occurring subsequent to firing. According to one embodiment, said means for holding is dimensioned such that said at least one component can be displaced in either direction linearly along said means for holding. For example, said at least one component may be displaced towards the end point of the means for holding closest to the front part of the barrel (the muzzle) or the end point closest to the rear part of the barrel.

According to one embodiment, the braking unit comprises an absorbing member comprising one or several springs having a total spring constant from 0.1 N to 10 kN/mm such as from 0.1 N to 800 N/mm, for example from 0.1 N to 500 N/mm, or from 200 to 500 N/mm. According to one embodiment, the total spring constant ranges from 0.1 to 10 N/mm. According to one embodiment, the absorbing member comprises a disc spring, also known as a Belleville washer;

coned disc spring, cup springs, conical washer or cupped spring washer, or combinations thereof.

According to one embodiment, stacks of springs may be used, for example a single stack or parallel stacks of springs. According to one embodiment, springs arranged in series may be used. Stacks of springs in the same direction results in an increase of the spring constant whereby a stiffer joint with the same deflection is obtained. Mixing and matching directions allow a specific spring constant and deflection capacity to be designed.

The present invention solves inter alia the problem of more precisely controlling the trajectory of a projectile resulting in less deviation of the projectile from the desired target. Preferably, the arrangement including the holding device, said at least one component and a braking unit is as small as possible to minimize the space it occupies. According to one embodiment, the holding device may take the shape of a cassette holding one or several components. The holding device may also comprise means for holding on its outer surface.

The braking unit is absorbing energy corresponding to the recoil caused by firing. Such energy may generally be calculated according to the following formula: $W=F_{max}\times d/2$, wherein W is the kinetic energy of the weapon proportional to the recoiling force; $F_{max}$ is the maximal force and d is the distance the weapon is displaced. Based on this, the braking unit can be dimensioned with absorbing members such as springs to absorb energies in a suitable range in relation to upcoming recoiling forces. According to one embodiment, the weight of the component(s) ranges from about 1 to 100 kg, e.g. from 1 to 20 kg or from 1 to 10 kg, for example from about 2 to about 5 kg, or from about 2 to about 3 kg, or from about 1 to 2 kg.

DESCRIPTION OF THE DRAWINGS AND THE INVENTION

FIG. 1 schematically discloses a recoiling system comprising a holding device 11 which consists of a holder 11*a*; and a braking unit 11*b* comprising a disc spring package (not shown). FIG. 1 also shows a sight 12 which is axially displaceable upon firing relative to and in parallel with barrel 13 (projectile leaves barrel 13 in the direction indicated by F). After firing in direction F, the barrel 13 and the holder 11*a* are caused to move in the opposite direction due to recoiling forces (in this particular example) indicated by the arrow at the barrel 13. As the barrel 13 and the holder 11*a* are transported backwards relative to the firing direction, the braking unit 11*b* and the sight 12 are eventually contacted with holder 11*a*. The braking unit 11*b* starts to absorb recoiling forces in a controlled manner when such contact is reached with holder 11*a*. This absorbing action occurs after the projectile has left the barrel.

Figure 2:
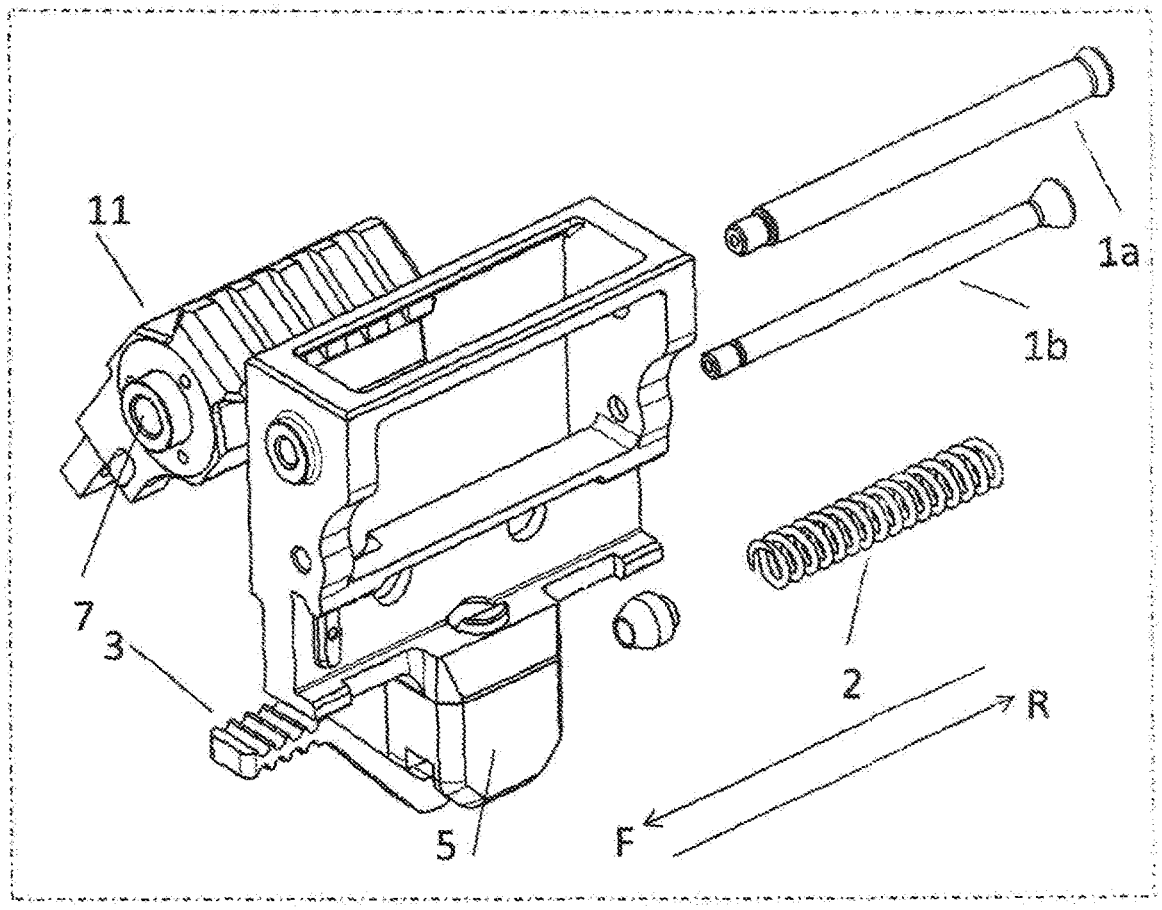
Figure 3:
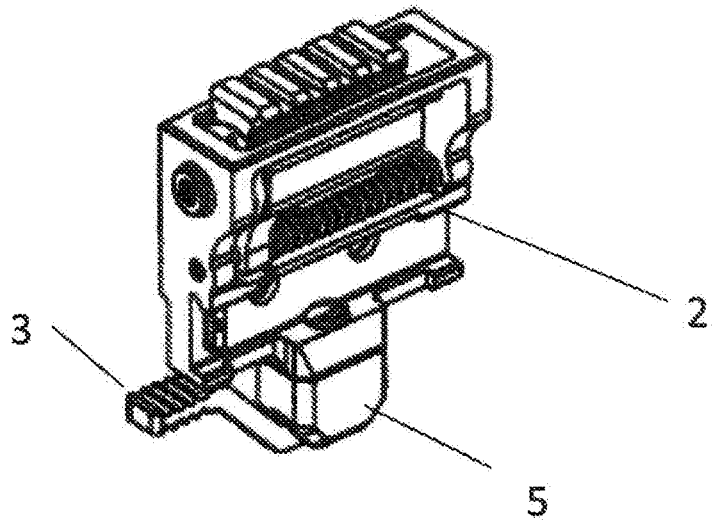
Figure 4:
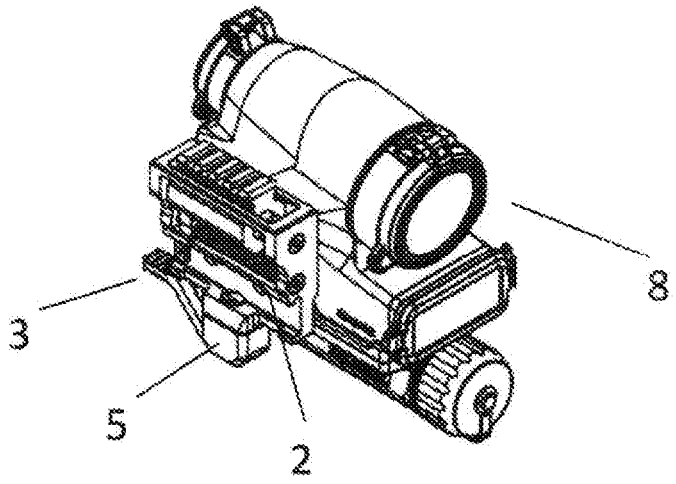

FIG. 2 shows a holding device comprising an interface surface 5 which is mounted on a barrel (not shown). The holding device is secured by locking mechanism 3. The holding device comprises means for holding, shaft 1*a*, on which braking unit 11*b* is mounted, through hole 7. A sight 8 is in turn mounted on braking unit 11*b* (further shown in FIG. 4). As the projectile leaves the barrel, the braking unit 11*b* and the sight are still in its original position while the barrel and holding device have moved backwards. A certain period of time after the projectile has left the barrel, the braking unit 11*b* will reach an end point of shaft 1*a* of the holding device 11 and recoiling forces will be absorbed through the braking unit 11*b* comprising resilient springs. A retraction shaft 1*b* is provided at which a weak retraction spring 2 is arranged for retracting the braking unit 11*b* and sight to its original position after the recoiling forces have been absorbed. The retraction spring does not substantially influence the component such that it starts to absorb any substantial recoiling forces prior to the projectile has left the barrel. The braking unit 11*b* mounted on shaft 1*a* and sight 8 mounted on the braking unit 11*b* remain in a standstill position initially while the barrel and the holding device are moved backwards relative to the fire direction (in other weapons, other directions of recoiling forces may apply). As evident from the disclosure herein, the braking unit 11*b* and the sight 8 (or any other component as defined herein) may be described to be displaced relative to the holding device even though the holding device per se describes a movement (backwards) due to arising recoiling forces after firing while braking unit 11*b* and sight 8 are not initially moving. After contact with an end point of the means for holding (e.g. a shaft), the braking unit 11*b* and the sight 8, however, start to absorb recoiling forces until the system finally stops whereupon the retraction spring 2 brings the system to its original position. In FIG. 2, the firing direction is indicated by an F, the recoiling direction of the barrel by an R. FIGS. 3 and 4 show the holding device from different perspectives.

The invention claimed is:

1. Arrangement for improving shooting accuracy of a weapon comprising a barrel;

at least one component, said at least one component comprises a braking unit;

a holding device mounted on said barrel, said holding device comprising means for holding said at least one component allowing said at least one component to be displaced relative to and in parallel with the barrel and the means for holding from 1 mm to 200 mm from a first position to a second position, during which displacement said at least one component does not absorb any substantial recoiling forces, wherein the at least one component reaches the second position after a projectile has left the barrel and the braking unit starts to absorb recoiling forces when the at least one component reaches the second position.

2. Arrangement according to claim 1, wherein said means for holding comprises at least one shaft along which said at least one component is displaced.

3. Arrangement according to claim 1, wherein said at least one component further comprises a sight.

4. Arrangement according to claim 1, wherein said at least one component is positioned prior to firing at said means for holding at a distance of from 5 mm to 20 mm from an end point of said means for holding.

5. Arrangement according to claim 1, wherein said at least one component includes a sight mounted on the braking unit.

6. Arrangement according to claim 1, wherein said at least one component is positioned from 5 to 15 mm from an end point of said means for holding.

7. Arrangement according to claim 1, wherein the braking unit is mounted on said means for holding allowing said braking unit to slide along said means for holding 2 to 20 mm without absorbing any substantial recoiling forces.

8. Arrangement according to claim 2, wherein the second position comprises an end of the at least one shaft.

* * * * *